US005497569A

United States Patent [19]

Byman

[11] Patent Number: 5,497,569

[45] Date of Patent: Mar. 12, 1996

[54] GROOMER ATTACHMENT FOR FORKLIFTS

[76] Inventor: Lorne Byman, 3865 Royston Road, Royston, British Columbia, Canada, V0R 2V0

[21] Appl. No.: 257,153

[22] Filed: Jun. 9, 1994

[51] Int. Cl.[6] ..... E02F 3/815; B66F 9/06

[52] U.S. Cl. ..... 37/410; 15/98; 15/245; 37/233; 37/266; 37/403; 37/407; 172/189; 172/247; 172/612; 172/684.5; 172/816; 414/607

[58] Field of Search ..... 15/98, 245; 37/232, 37/233, 266, 403, 407, 410, 405, 449; 172/189, 247, 612, 684.5, 701.1, 786, 816; 414/607, 722

[56] References Cited

U.S. PATENT DOCUMENTS

| | | | |
|---|---|---|---|
| 533,131 | 1/1895 | Knight | 15/245 |
| 1,897,726 | 2/1933 | Hillyard | 15/245 |
| 2,818,534 | 12/1957 | Horne | 15/245 |
| 2,902,909 | 9/1959 | Reissinger | 172/612 |
| 3,283,933 | 11/1966 | Wal | 414/607 |
| 3,587,893 | 6/1971 | Laken | 414/607 |
| 3,866,342 | 2/1975 | Cooper | 37/407 |
| 5,054,150 | 10/1991 | Best | 15/52.1 |
| 5,165,134 | 11/1992 | Moore | 15/98 |
| 5,212,848 | 5/1993 | Geyer | 15/245 X |
| 5,221,176 | 6/1993 | Allen | 414/785 |

FOREIGN PATENT DOCUMENTS

| | | | |
|---|---|---|---|
| 277077 | 8/1988 | European Pat. Off. | 414/607 |
| 2920X | 2/1956 | Germany | 15/245 |

*Primary Examiner*—Kenneth J. Dorner
*Assistant Examiner*—Andrea Chop
*Attorney, Agent, or Firm*—Norman M. Cameron

[57] ABSTRACT

A groomer attachment for forklift vehicles includes an elongated rigid member having a top and a bottom. A pair of spaced-apart fork receiving pockets are connected to the rigid member. A flexible blade extends from the bottom of the rigid member. Preferably the rigid member has a front and a rear. The attachment then has a pair of spaced-apart flexible blades extending from the bottom of the rigid member, a first blade being adjacent the front thereof and a second blade being adjacent the rear thereof. The rigid member may be channel-shaped.

3 Claims, 2 Drawing Sheets

GROOMER ATTACHMENT FOR FORKLIFTS

BACKGROUND OF THE INVENTION

This invention relates to groomer attachments for forklifts.

Moving and shaping soil, sand or debris is a task often encountered in landscaping and many industrial sites including, for example, sawmills. Such grooming jobs are sometimes attempted using a steel bucket or steel blade on a front-end loader or other type of tractor. Not only does this require special equipment on site, but such buckets and blades are rough, noisy and generally not well adapted to many such tasks. For example, the steel blades often catch on immovable objects such as slabs of concrete encountered during the grooming operation.

Forklift vehicles, also called "forklifts", are commonly used on many industrial sites such as sawmills. These are normally used for lifting pallets, containers, lumber and other such objects. Because they are so readily available, it would be desirable to utilize these vehicles if possible for other tasks such as clearing debris and grooming the surface of the ground.

Many attachments have been devised for forklift trucks such as the forklift mounted sweeping machine disclosed in U.S. Pat. No. 5,054,150 to Best et al. However, this device is not well adapted for grooming operations or even exterior debris clearing on unpaved surfaces.

SUMMARY OF THE INVENTION

It is an object of the invention to provide an improved groomer which is simple, rugged and inexpensive to produce and sell.

It is also an object of the invention to provide an improved-groomer attachment capable of fitting standard forklifts.

It is a further object of the invention to provide an improved groomer which is capable of moving soil and debris over flat surfaces, but which can accommodate irregularities in the surfaces as well as immovable objects encountered on surfaces during such operations.

It is a still further object of the invention to provide an improved groomer apparatus which satisfactorily cleans and grooms large areas at a relatively fast rate compared with prior art devices.

In accordance with these objects, there is provided a groomer attachment for forklift vehicles. The attachment includes an elongated rigid member with a top and a bottom. There is a pair of spaced-apart fork receiving pockets connected to the rigid member. A flexible blade extends from the bottom of the rigid member.

Preferably the attachment has a pair of spaced-apart flexible blades which extend from the bottom of the rigid member. A first said blade is adjacent the front of the rigid member and a second said blade is adjacent the rear thereof.

The rigid member may be channel shaped, including an outer channel and an inner channel received therein. A flexible member is received between the channels and extends outwardly therefrom at the front and the rear of the rigid member to form the blades. There may be an elongated-tension member for connecting the rigid member to the forklift vehicle.

DESCRIPTION OF THE PREFERRED EMBODIMENTS

Figure 1:
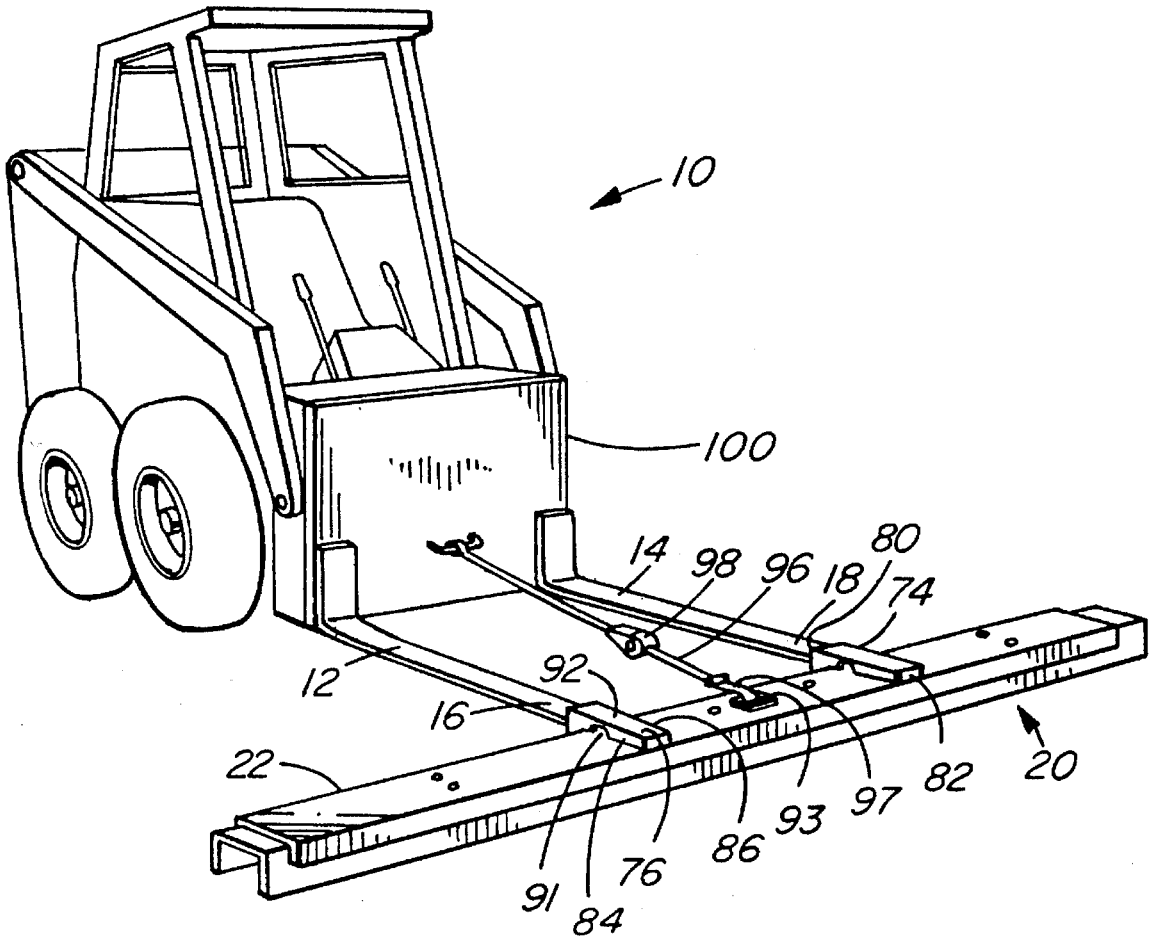
FIG. 1 is a top, front isometric view showing a forklift vehicle in fragment with a groomer attachment mounted thereon.

Referring to the drawings, and first to FIG. 1, this shows a standard forklift vehicle 10, in this case a pallet loader, which includes a pair of forks 12 and 14 extending forwardly from the front of the vehicle to tips 16 and 18 thereof. A groomer attachment, shown generally at 20, is mounted on the tips of the forks. The groomer attachment includes an elongated, rigid member 22, shown best in FIG. 2–5, having a top 24, a bottom 26, a front 28, and a rear 30. The member is perpendicular to the forks. As seen best in FIG. 3, the member 22 is formed by two channels, an outer channel 34 on top and an inner channel 36 on the bottom. The outer channel has a pair of downwardly extending flanges 38 and 40, while the inner channel has flanges 42 and 44 which are parallel thereto and spaced-apart inwardly therefrom. In the preferred embodiment the outer channel is 9' long and 10" wide. The inner channel is the same length and 9" wide. However the exact size can be altered to suit requirements and the particular forklift vehicle employed.

Figure 3:
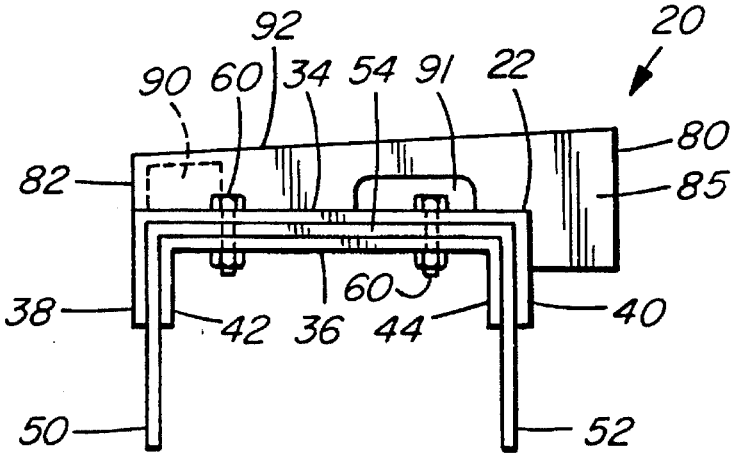
FIG. 3 is an end view thereof.
Figure 2:
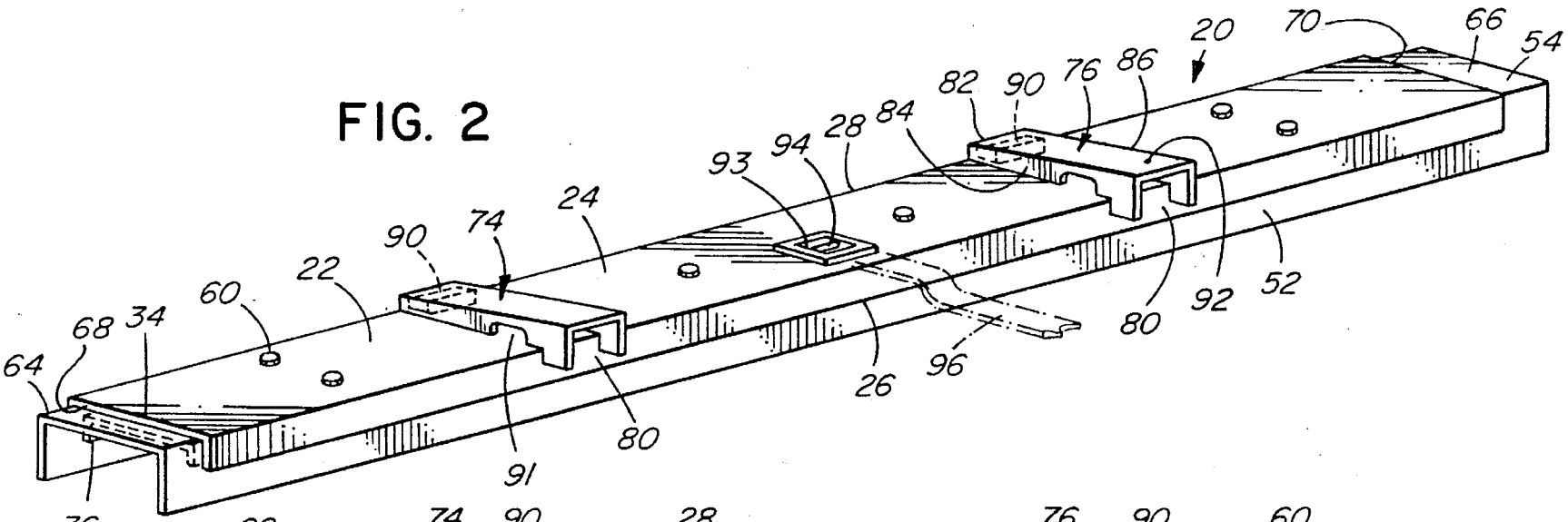
FIG. 2 is a top, rear isometric view of the groomer attachment.
Figure 4:
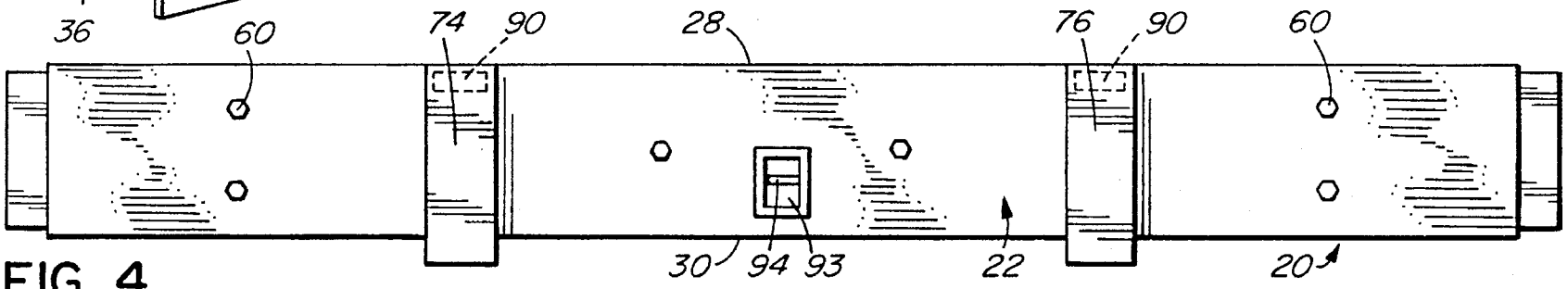
FIG. 4 is a top plan thereof.
Figure 5:
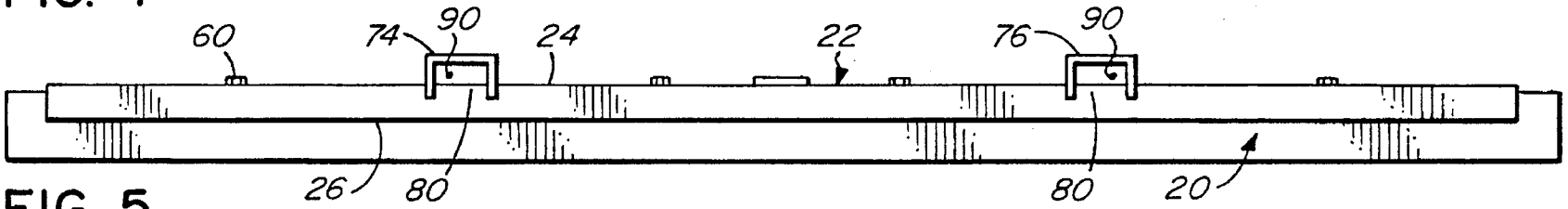
FIG. 5 is an elevation thereof.

There is a pair of flexible blades 50 and 52, both shown in FIG. 3, which extend downwardly from the bottom 26 of the rigid member 22. In alternative embodiments a single blade could be used or more than two blades as desired. The blades 50 and 52 comprise the ends of a thin, flexible member 54 which, in this example, is a rectangular piece of reinforced belting. The belting is ½" thick in this embodiment although the exact size and thickness as well as the exact material can be changed in other embodiments of the invention.

As seen best in FIG. 3 the member 54 is sandwiched and compressed between the two channels 34 and 36. A plurality of bolts 60 extend through corresponding apertures in the channels and the flexible member. These bolts are tightened so that the flexible member is compressed between the channels. Thus the blades 50 and 52 are substantially vertical in the position for use as shown in FIG. 3. The blades 50 and 52 are formed by portions of the flexible member which project downwardly below the channels, approximately 3" in this particular example. Moreover, the flexible member has portions 64 and 66 which extend outwardly beyond ends 68 and 70 of the member 22. These portions are approximately 3" wide in this particular case.

There is a pair of spaced-apart fork receiving pockets 74 and 76 mounted on top 24 of member 22. Each of these pockets has an open rear 80 and a closed front 82. Each of the pockets is formed by a pair of spaced-apart sides 84 and 86 which are generally trapezoidal so that the pockets taper downwardly toward the fronts thereof. In this embodiment each side has a rear portion 85 which extends rearwardly beyond flange 40 and downwardly below top 24 of member 22 to strengthen the pockets as seen in FIG. 3. There is a top plate 92 on each pocket extending between the sides thereof.

There is a resilient insert 90 located within the closed front end of each of the pockets. In the preferred example these inserts are small rectangular pieces of reinforced belting similar to member 54. These serve to cushion the forks of the forklift vehicle as they are inserted into the pockets. The exact size and spacing of the pockets depends upon the forklift employed. The pockets have opening 91 on the sides 84 and 86 for clearing debris from inside the pockets.

There is a rectangular recess 93 located centrally on the top of member 22. A pin 94 extends across the recess. A hook-like clasp 97, shown in FIG. 1, releasably engages the pin 94. The clasp is connected to a tension member, in this ease nylon webbing 96 provided with a ratchet 98. The assembly of clasp 97, webbing 96 and ratchet 98 is conventional and is known as a ratchet buckle. The opposite end 100 of the webbing is connected to the front of the forklift. The webbing and clasp serve to keep the groomer attachment 20 on the forks of the forklift.

In use, the groomer attachment 20 is mounted on the forklift by inserting the tips 16 and 18 of the forks 12 and 14 into the pockets 74 and 76. Clasp 97 is then placed over the pin 94 and the ratchet 98 is used to tighten the webbing 96 to hold the groomer attachment in place. The forklift is lowered until the flexible blades 50 and 52 contact the surface to be groomed. The forklift truck can then be driven forwards or rearwards to perform the required grooming operation.

The apparatus is capable of performing many operations including moving and shaping gravel, sand, coarse rock and soil. The apparatus can be used for landscaping top soil or to place top soil in specified areas. Mounting the groomer attachment on a forklift vehicle means that it is capable of reaching up steep slopes or extreme heights. The apparatus is also suitable for removing snow or slush from large surfaces and piling it to considerable heights. The apparatus can be used for levelling freshly poured concrete, cleaning debris from barns, warehouses, shops, driveways, sidewalks, school yards and bins. It is also capable of flattening undesirable weeds and brush, while not disturbing the ground surface. It can also safely clean up hazardous materials such as spilled diesel fuel or chemicals. Because of the resilient blades, this can be done without producing sparks which could cause ignition of inflammable materials. The portions of the groomer attachment extending outwardly beyond the forks allow the device to be inserted between floors or under decks to perform cleaning operations. The protruding portions 64 and 66 of the flexible member 54 prevent damage to the apparatus or to stationary objects if the groomer attachment accidentally contacts them. It will be understood by someone skilled in the art that many of the details provided above are by way of example only and are not intended to limit the scope of the invention which is to be interpreted with reference to the following claims.

What is claimed is:

1. A groomer attachment for forklift vehicles, comprising:

an elongated rigid member having a top and a bottom;

a pair of spaced-apart fork receiving pockets connected to the rigid member, the pockets having open rear ends for receiving forks and front ends with resilient internal cushions; and a flexible blade extending from the bottom of the rigid member.

2. A groomer attachment as claimed in claim 1, wherein the pockets have side openings therein.

3. A grooming machine, comprising:

a forklift vehicle having a front with a pair of spaced-apart forks extending therefrom, the forks having outer ends;

an elongated rigid member extending perpendicular to the forks and having an outer channel with a top and downwardly extending front and rear flanges and an inner channel received within the outer channel therebelow and having front and rear flanges parallel to the flanges of the outer channel;

a pair of pockets connected to the top of the outer channel, the outer ends of the forks extending into the pockets, the pockets having open rear ends receiving the forks and closed front ends with resilient internal inserts; and a thin, flexible member received between the two channels and having parallel edges extending downwardly beyond the flanges of the inner and outer channels.

* * * * *